US009394777B2

(12) United States Patent
Cheng et al.

(10) Patent No.: US 9,394,777 B2
(45) Date of Patent: Jul. 19, 2016

(54) PRESSURE CONTROLLED MULTI-SHIFT FRAC SLEEVE SYSTEM

(71) Applicant: CNPC USA Corp., Houston, TX (US)

(72) Inventors: Peng Cheng, Missouri City, TX (US); Marvin Allen Gregory, Spring, TX (US)

(73) Assignee: CNPC USA Corp., Houston, TX (US)

( * ) Notice: Subject to any disclaimer, the term of this patent is extended or adjusted under 35 U.S.C. 154(b) by 361 days.

(21) Appl. No.: 14/099,438

(22) Filed: Dec. 6, 2013

(65) Prior Publication Data

US 2014/0158361 A1 Jun. 12, 2014

Related U.S. Application Data

(60) Provisional application No. 61/734,561, filed on Dec. 7, 2012.

(51) Int. Cl.

| | |
|---|---|
| ***E21B 43/16*** | (2006.01) |
| ***E21B 43/26*** | (2006.01) |
| ***E21B 23/00*** | (2006.01) |
| ***E21B 23/04*** | (2006.01) |
| ***E21B 34/14*** | (2006.01) |
| *E21B 34/00* | (2006.01) |

(52) U.S. Cl.

CPC ..... *E21B 43/26* (2013.01); *E21B 23/006* (2013.01); *E21B 23/04* (2013.01); *E21B 34/14* (2013.01); *E21B 2034/007* (2013.01)

(58) Field of Classification Search

CPC ... E21B 2034/007; E21B 34/14; E21B 43/26; E21B 23/006; E21B 34/102

See application file for complete search history.

(56) References Cited

U.S. PATENT DOCUMENTS

| | | | | |
|---|---|---|---|---|
| 5,183,114 | A | 2/1993 | Hammet et al. | |
| 7,703,510 | B2 | 4/2010 | Xu | |
| 8,662,178 | B2 * | 3/2014 | Norrid | E21B 34/102 166/305.1 |
| 2006/0243455 | A1 * | 11/2006 | Telfer | E21B 21/103 166/386 |
| 2008/0314595 | A1 * | 12/2008 | Khomynets | E21B 43/124 166/308.2 |
| 2010/0032155 | A1 * | 2/2010 | Darnell | E21B 34/14 166/188 |
| 2011/0168410 | A1 * | 7/2011 | deBoer | E21B 21/10 166/386 |

(Continued)

OTHER PUBLICATIONS

Weatherford International Ltd., "ZoneSelect Multishift Frac Sliding Sleeve," white paper, 2011 (published on the web at http://www.weatherford.com/dn/WFT112166).

*Primary Examiner* — Daniel P Stephenson

(74) *Attorney, Agent, or Firm* — Andrew W. Chu; Craft Chu PLLC

(57) ABSTRACT

A frac sleeve system includes an outer sleeve with openings, an inner sleeve with ports, a pressure seat, a bottom locking device and a spring device. In a closed configuration of the inner sleeve, the openings and ports are not aligned for any fluid connection. In an opened configuration, at least one opening is aligned with at least one port for a fluid connection through the system. The inner sleeve shifts back and forth between configurations according to the pressure seat and the spring. The interaction of a guide pin on the outer sleeve and the guide slot on the inner sleeve controls the rotational and longitudinal movement of the inner sleeve along the common axis of the inner sleeve and outer sleeve so that there is unlimited shifting between configurations. The locking devices and spring device are also reuseable for the multiple shifting.

20 Claims, 4 Drawing Sheets

(56) References Cited

U.S. PATENT DOCUMENTS

2012/0181044 A1* 7/2012 Nikiforuk ..... E21B 7/20 166/374
2014/0014360 A1* 1/2014 Wilson ..... E21B 21/103 166/373
2014/0069654 A1* 3/2014 Hofman ..... E21B 34/103 166/308.1
2014/0158361 A1* 6/2014 Cheng ..... E21B 23/006 166/308.1
2016/0017690 A1* 1/2016 Baudoin ..... E21B 34/14 166/318

* cited by examiner

PRESSURE CONTROLLED MULTI-SHIFT FRAC SLEEVE SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a downhole tool for oil and gas production. More particularly, the present invention relates to a frac sleeve system. Even more particularly, the present invention relates to a frac sleeve system with unlimited shifting between opened and closed ports without mechanical intervention by a setting tool.

2. Description of Related Art Including Information Disclosed Under 37 CFR 1.97 and 37 CFR 1.98

Frac sleeve systems were developed to replace the slow and expensive process of running individual bridge plugs to isolate segments of a well with multiple stimulation targets along the wellbore. The wellbore runs through multiple zones of productivity within the earth. Bridge plugs and packers are deployed one at a time to isolate the productive zones. The one-by-one installation is not efficient, and a frac sleeve was developed to isolate multiple zones with a single tool.

The frac sleeve has a plurality of ports along the length of the sleeve. The ports are selectively opened or closed depending upon the desired zone. The control of the ports has been performed by a ball dropping through the pipeline. A ball travels through the pipeline to engage a pressure seat of the frac sleeve. A ball of a particular diameter or particular weight will open or close a particular set of ports at the desired depth. The types of balls and pressure seats can be set to control opening and closing of ports along the frac sleeve.

Current frac sleeve systems disclose different structures and methods to control opening and closing of ports, including selectively opening some ports and not others. Differential pressure actuated tools can be activated by a single seat, such that differential pressure across the single seat is used to open different ports at different times. Alternatively, multiple balls with different diameters and weights can fall through the pipeline and activate a respective pressure seat, according to which ball is dropped. Frac sleeve systems have also enabled the same ball to be able to drop through several seats to activate different ports, instead of relying upon multiple balls with different diameters.

Besides controlling which ports are opened, current frac sleeve systems re-close the ports or open another set of ports, after the initial activation. A frac sleeve system has ports in the closed position, while being run-in the borehole to the proper location. Once placed, the frac sleeve system is activated so that a first set of ports is opened. After the frac or production activity is completed, the first set of ports can be closed and/or a second set of ports can be opened for a new frac or production activity. The current frac sleeve systems can proceed to the next activity without removing the spent frac sleeve system and replacing with a new frac sleeve system. For example, a dissolvable ball releases the pressure seat to return the frac sleeve to an original configuration. A ball can also be dislodged from the pressure seat by flow restrictors or differential pressure within the tool. Some pressure seats can also be set to count a number of balls passing through, so as to close the ports after a pre-determined number of balls has passed through the pressure seat. Also, other structures, such as outer and inner sleeves can move relative orientation to each other for a second set of ports to open, while the first set of ports close. A separate shifting tool can also be deployed to re-close the ports or open another set of ports. Other technology in the field of frac sleeve systems affects flow into the frac sleeve from the desired zone, such as flow restricted ports, and a swivel sub for horizontal wellbores.

A frac sleeve system 1 generally includes an outer sleeve 2, an inner sleeve 3, a locking ring 4, a ball seat 5, and a plurality of ports 6 in the inner sleeve 3 as shown in FIGS. 1A and 1B. The frac sleeve system 1 starts in the closed position in FIG. 1A with the locking ring 4 holding the inner sleeve 3 in place relative to the outer sleeve 2. The ports 6 of the inner sleeve are not aligned with openings 7 on the outer sleeve 2, so that there is no fluid flow through the frac sleeve system 1. Once positioned, a ball 8 is dropped through the borehole to engage the ball seat 5. The ball 8 triggers the locking ring 4 to disengage, and the inner sleeve 3 is slidable relative to the outer sleeve 2. The ball 8 or fluid pressure from the surface can increase pressure to break the locking ring 4 to release the inner sleeve 3. The inner sleeve 3 slides into a position of alignment of the ports 6 and openings 7 so that fluid can flow through the frac sleeve system 1. Delivery of fluid through the frac sleeve system 1 can now be accomplished in this open position shown in FIG. 1B. The ball 8 does not always remain in the ball seat 5 in the open position, so that fluid can be delivered more easily.

The prior art frac sleeve system 1 includes various known means to re-close the system 1 to stop the fluid flow. There is no downward originating force available to return the inner sleeve to the locking ring. Fluid pressure is pumped down from the surface, not up from the borehole. The prior art includes dropping a different sized ball to trigger the inner sleeve to slide further down the outer sleeve, while also moving the ports out of alignment with the openings. Alternatively, a spring 9, shown in FIG. 1B, can provide a return force on the inner sleeve back towards the locking ring to again change alignment of the ports and openings. However, the spring 9 would still require another ball and fluid pressure from the surface to compress the spring 9. There is also the limitation that the spring 9 cannot return the inner sleeve to the locking ring. The amount of upward slide of the inner sleeve would be determined by the length of the spring 9 in the un-compressed state. As such, regardless of how the prior art frac sleeve systems are opened and then closed, these prior art systems are not re-useable. The original sequence from closed to opened cannot be replicated without generation of pressure toward the locking ring.

The setting tool is another prior art option to re-close the system 1. Coiled tubing or wireline intervention delivers a tool to the frac sleeve. The tool mechanically closes the open ports, re-setting the frac sleeve for another ball. The intervention requires stoppage time, so that the production ceases for the delivery of the setting tool through the wellbore. There is also the risk of damage to the wellbore, as different tools are lowered each time to re-close the ports.

It is an object of the present invention to provide an embodiment of the frac sleeve system that is reuseable.

It is an object of the present invention to provide an embodiment of the frac sleeve system that can be opened and closed repeatedly.

It is another object of the present invention to provide an embodiment of the frac sleeve system with a reuseable top locking means for a closed position.

It is another object of the present invention to provide an embodiment of the frac sleeve system with a reuseable bottom locking means for an open position.

It is another object of the present invention to provide an embodiment of the frac sleeve system with a reuseable spring means for returning an open configuration to a closed configuration.

It is still another object of the present invention to provide an embodiment of the frac sleeve system with an improved inner sleeve member and outer sleeve or outer housing.

It is still another object of the present invention to provide an embodiment of the frac sleeve system with an inner sleeve member having a guide slot.

It is still another object of the present invention to provide an embodiment of the frac sleeve system with an outer housing having a guide pin engaged with a guide slot of an inner sleeve member.

It is still another object of the present invention to provide an embodiment of the frac sleeve system with a guide slot and guide pin to control the use of pressure to moving between a closed configuration and an open configuration.

It is yet another object of the present invention to provide an embodiment of the frac sleeve system with a reuseable spring means with a torque portion.

It is yet another object of the present invention to provide an embodiment of the frac sleeve system with a reuseable spring means to provide a twisting force to the inner sleeve.

These and other objectives and advantages of the present invention will become apparent from a reading of the attached specifications and appended claims.

SUMMARY OF THE INVENTION

Embodiments of the frac sleeve system include an outer sleeve, an inner sleeve, a pressure seat, a bottom locking device and a spring device. The outer sleeve has a top housing and a bottom housing, fixedly engaged to each other to be made integral. The outer sleeve also has openings. The inner sleeve is positioned within the outer sleeve along a common longitudinal axis. The inner sleeve is longitudinally and rotationally slidable relative to said outer sleeve on and along the common axis. There are ports in the inner sleeve, which can align with the openings of the outer sleeve. In a closed configuration of the inner sleeve, the openings and ports are not aligned for any fluid connection through the system. In an opened configuration of the inner sleeve, at least one port is aligned with at least one opening, for fluid connection through the system. The inner sleeve shifts back and forth between configurations according to the pressure seat and the spring. In the closed position, the frac sleeve system in can be run-in hole to the proper location in the borehole.

The interaction of a guide pin on the outer sleeve and the guide slot on the inner sleeve controls the rotational and longitudinal movement of the inner sleeve along the common axis of the inner sleeve and outer sleeve so that there is unlimited shifting between configurations. The outer sleeve has a guide pin means at a fixed location on an inner surface of the top housing. The guide pin means can be a protrusion extended inward toward the inner sleeve. The inner sleeve has a guide slot means on an outer surface. The guide pin means engages the guide slot means, corresponding to shifting between configurations. The guide slot means is continuous and circumscribes the outer surface of the inner sleeve so that the guide pin remains disposed in the guide slot means in all configurations. Various embodiments have the guide slot means as a concavity or channel or slot for male-female engagement with the protrusion of the guide pin means.

Slot positions in the guide slot means correspond to configurations of the inner sleeve. There is a first slot position corresponding to the closed configuration, when the guide pin means is disposed in the first slot position. There is a second slot position corresponding to the opened configuration, when the guide pin means is disposed in the second slot position, and there is a third slot position corresponding to a compressed configuration, when the guide pin means is disposed in the third slot position and the spring means is in a compressed state. The inner sleeve shifts from the closed configuration to the opened configuration, from the opened configuration to the compressed configuration and then back to the closed configuration. The path of the guide slot means is continuous around the inner sleeve, so the slot positions repeat over and over for unlimited shifts. The path of the guide slot means between slot positions has different shapes, relative to the common axis of the sleeves. Some paths are linear, corresponding to longitudinal movement of the inner sleeve relative to the outer sleeve. Other paths are non-linear, such as curved, bent, or angled, corresponding to rotational and longitudinal movement. The longitudinal and rotational pressures from the pressure seat and the pressure from the spring are controlled and directed by the interaction between the guide pin and the guide slot of the present invention.

In other embodiments, the system also includes a top locking device, in addition to the bottom locking device. The top locking device holds the inner sleeve in the closed configuration until enough pressure builds to release the lock. The top locking device can also have a top locking ring in the outer sleeve, which blocks the inner sleeve from longitudinal movement too far from the top locking device, when the spring returns the inner sleeve to the closed configuration from the compressed configuration. The bottom locking device can hold the inner sleeve in the opened position for maintaining the fluid connection through the system. The fracturing fluid can be pumped into the wellbore, and production fluid from the wellbore can also be collected through the system in this configuration.

The longitudinal and rotational pressures are provided from the pressure seat and the pressure from the spring. The pressure seat can be a ball seat/frac ball combination or other type of valve with sensitivity to fluid pressure from the surface, such as a float valve with shear pins. The pressure seat can also be a combination of more than one ball seat/frac ball combinations. One ball seat/frac ball combination can be set for shifting from closed to opened configuration. A different ball seat/frac ball combination with different sizes and pressure requirements, can be set on the system for shifting from opened configuration to compressed configuration. The pressure seat means provides downward pressure from the surface. The spring can be a torque compression spring to control inner sleeve movement from the opened configuration to the compressed configuration, and from the compressed configuration to the closed configuration. The spring provides rotational pressure during both downward and upward movemember, and upward pressure towards the surface.

In embodiments of the present invention, the frac sleeve system shifts between configurations an unlimited number of times. There is no need for well intervention by setting tools to re-set the inner sleeve, even after repeated cycles of opening and closing. In the method of the present invention, system is installed in a pay zone of the wellbore in a closed configuration with the guide pin in a first slot position of the guide slot. The inner sleeve shifts from closed to opened configuration when the pressure from the surface engages the pressure seat mean, causing longitudinal movement of the inner sleeve downward. The movement makes a fluid connection through the system by alignment of the openings and ports. The fracturing and production can be performed in this opened configuration. When the downhole activity is complete, pressure from the surface engages the inner sleeve again with the guide pin in the second slot position. The downward pressure from the surface compresses the spring, and the rotational and longitudinal forces are guided by the guide pin following the path of the guide slot to the compressed configuration.

When the downward pressure from the surface is stopped, the upward pressure of the spring shifts the inner sleeve from the compressed configuration back to the closed configuration. The guide pin follows from the second slot position to a third slot position to control the rotational and longitudinal upward forces of the spring. The shifting is repeated back and forth by the pressure from the surface and the spring for multiple shifts between configurations, depending upon the desired downhole activity. Various methods of exerting the pressure from the surface on the pressure seat are available in embodiments of the present invention, including but not limited to ball seat and frac ball combinations. The shaped guide slot and guide pin direct the forces and movement so that the locking devices and pressure seat of the system are reuseable and that the original positions of the inner sleeve for the closed configuration, opened configuration, and compressed configuration, can be replicated with consistency and accuracy.

DETAILED DESCRIPTION OF THE DRAWINGS

Figure 1A:
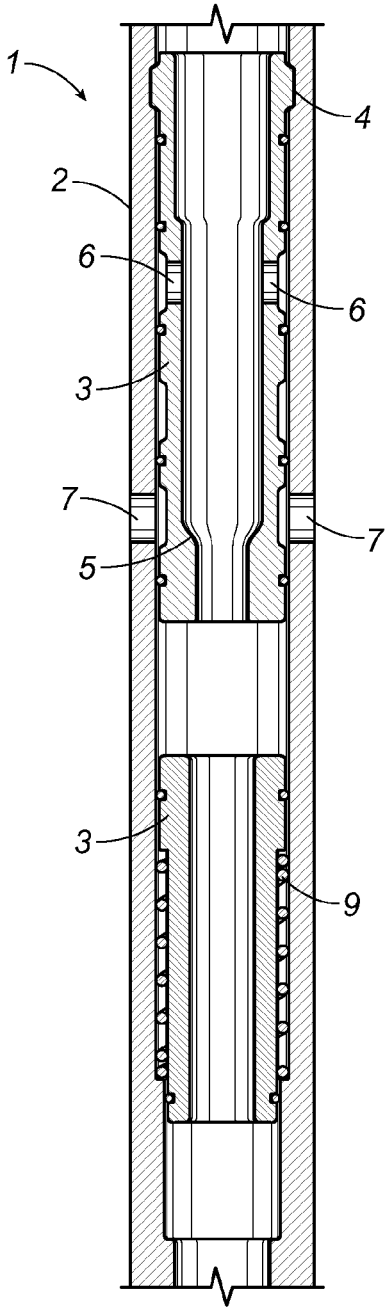
FIG. 1A Prior Art
FIG. 1A is a schematic view of a prior art frac sleeve system, showing a closed configuration.
Figure 1B:
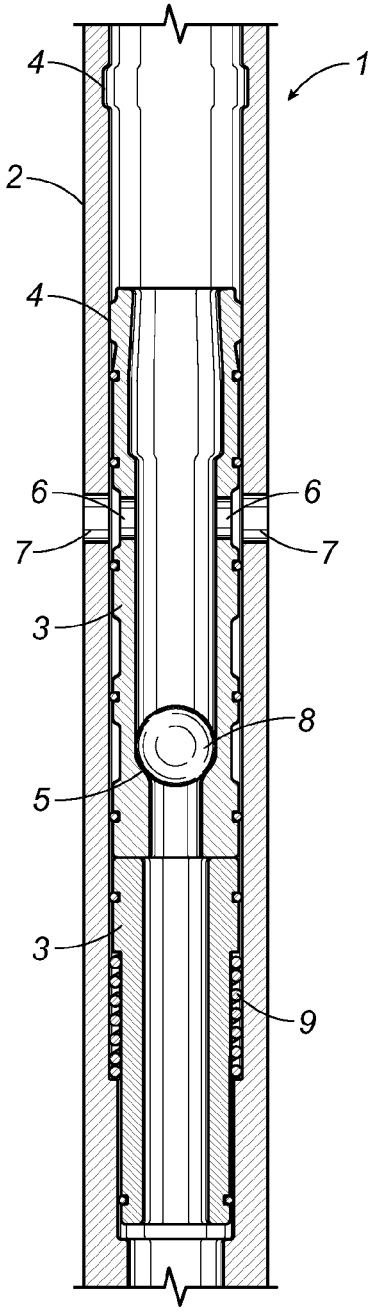
FIG. 1B Prior Art
FIG. 1B is another schematic view of the prior art frac sleeve system, showing an open configuration.
Figure 2:
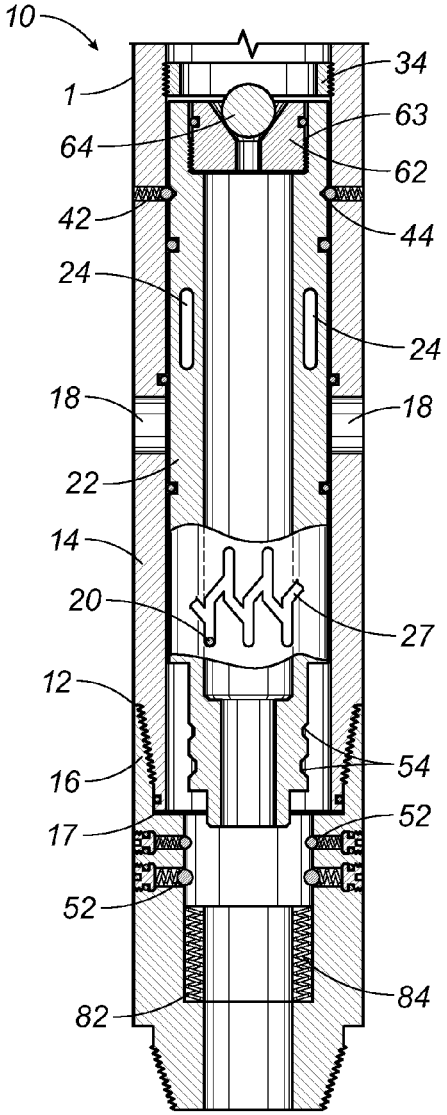
FIG. 2 is a cross-sectional view of an embodiment of the frac sleeve system of the present invention, showing a closed configuration.
Figure 3:
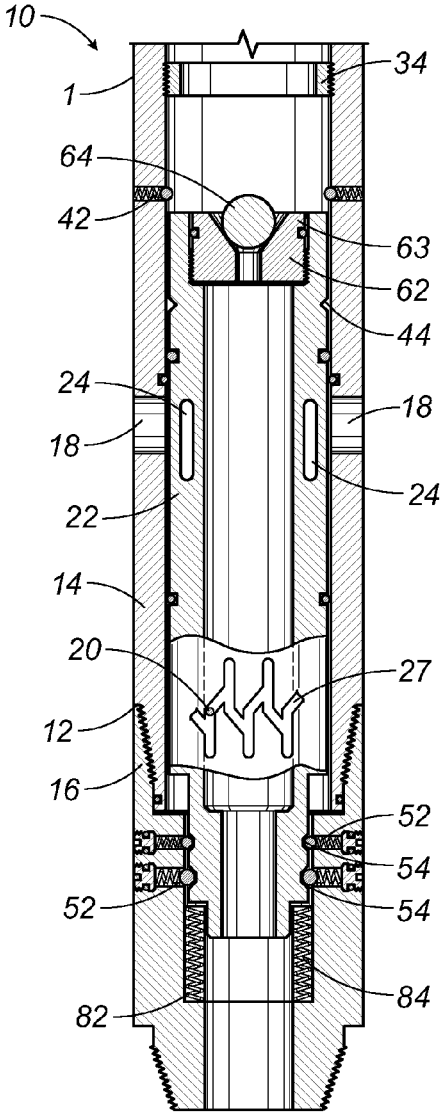
FIG. 3 is a cross-sectional view of an embodiment of the frac sleeve system of the present invention, showing an opened configuration.
Figure 4:
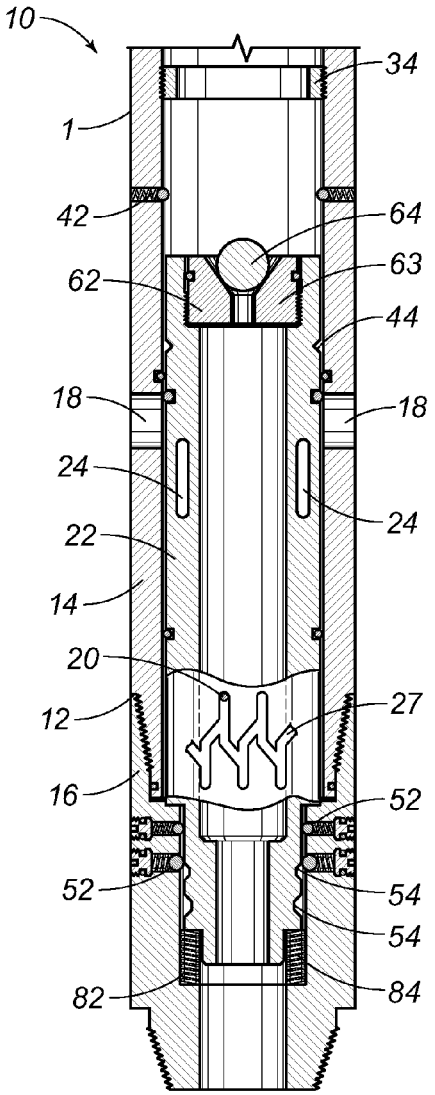
FIG. 4 is a cross-sectional view of an embodiment of the frac sleeve system of the present invention, showing a compressed configuration.

Referring to FIGS. 2-4, embodiments of the frac sleeve system 10 of the present invention are shown in closed configuration, opened configuration, and compressed configuration, respectively. The frac sleeve system 10 moves between the closed, opened, and compressed configurations without the need for setting tools or other well interventions. Pressure from the surface controls the multiple shifts between configurations with accuracy and consistency. No mechanical intervention is required to achieved the unlimited shifts possible with embodiments of the present invention.

The frac sleeve system 10 includes an outer sleeve 12 comprised of a top housing 14 and a bottom housing 16. The top housing 14 fixedly engages the bottom housing 16, such that the top housing 14 and the bottom housing 16 are generally made integral with each other. FIGS. 2-4 show the top housing 14 and bottom housing 16 in threaded engagement with a seal member 17. The housings 14, 16 are not rotatable relative to each other once connected. The top housing 14 and bottom 16 housing may also be friction fit or snap fit for a resilient connection to make integral. The outer sleeve 12 further comprises a plurality of openings 18 positioned on the top housing 14. The openings 18 allow access, including fluid connection with the wellbore. The openings 18 can constitute a frac window, when placed in a pay zone of the wellbore for production or a frac zone in the wellbore for fracturing.

In embodiments of the present invention, the outer sleeve 12 further comprises a guide pin means 20 on an inner surface of the top housing 14. The guide pin means 20 can be a protrusion, which remains fixed in position on the inner surface of the top housing 14. Other types of guide pin means include shafts, tubular members, bumps, or other structures to engage the inner sleeve 22. The guide pin means 20 extends into an interior of the outer sleeve 12 to engage the inner sleeve 22.

The frac sleeve system 10 also includes the inner sleeve 22, which is positioned within the outer sleeve 12 along a common longitudinal axis. The inner sleeve 22 is longitudinally and rotationally slidable relative to the outer sleeve 12 on and along the common axis. The inner sleeve 22 can twist and oscillate within the outer sleeve 12. The inner sleeve 22 is further comprised of a plurality of ports 24 or frac slots. The ports 24 are holes in the inner sleeve 22, which allow access to the interior of the frac sleeve system 10. The ports 24 are in fluid connection with the interior of the inner sleeve 22 and the overall system 10. The ports 24 are radially arranged on the common axis of the sleeves 12, 22. The number of ports 24 is variable. The ports 24 may be arranged in a ring or spaced apart longitudinal on the inner sleeve 22. Fluid connection to the surface is accessible through the ports 24.

As shown in FIG. 2, none of the ports 24 are aligned with any of the openings 18 in the closed configuration. There is no fluid connection from the wellbore to the surface through the interior of the inner sleeve 22 and overall system 10. The misalignment of ports 24 and openings 18 can be longitudinal along the common axis of the sleeves 12, 22 or rotational on the common axis of the sleeves 12, 22. That is, the inner sleeve 22 may also be rotated to mis-align a port 24 with an opening 18. As shown in FIG. 3, at least one of the ports 24 is aligned with at least one of the openings 18 in an opened configuration. With one alignment, there is a fluid connection maintained through the opening 18, the ports 24 and the interior of the inner sleeve 22. In the opened configuration, fluid connection between the surface and the wellbore is achieved for fracturing or production purposes. Fracturing fluid can be pumped to the pay zone through the window created by the openings 18 and ports 24.

Figure 5:
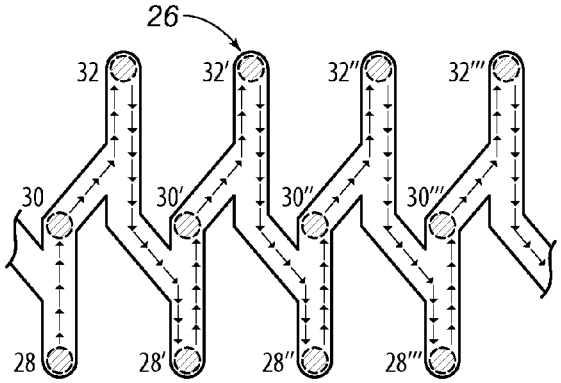
FIG. 5 is an isolated schematic view of an embodiment of the guide slot means on the inner sleeve of the frac sleeve system of the present invention.

In embodiments of the frac sleeve system 10 of the present invention, the inner sleeve 22 has a guide slot means 26, shown in partial detail in FIG. 5. The guide slot means 26 circumscribes an outer periphery of the inner sleeve 22, forming a shaped slot ringed around the inner sleeve 22. The guide slot means 26 is continuous around a circumference of the outer surface of the inner sleeve 22. The guide slot means 26 is shaped to fit to the guide pin means 20, so that the guide pin means 20 is contained in the interior of the guide slot means 26. The inner sleeve 22 rotates and oscillates along the common axis within the outer sleeve 12 relative to the fixed guide pin means 20 on the outer sleeve 12. The movements on the common axis relative to the fixed guide pin means 20, by rotation or by longitudinally displacement, are determined by the guide slot means 26.

In one embodiment of FIGS. 4 and 5, the guide slot means 26 is a shaped channel 27, a slot or grooved cylindrical surface for controlling the movement of the inner sleeve 22 relative to the guide pin means 20 and the outer sleeve 12. The guide slot means 26 is a concavity in the outer surface of the inner sleeve 22. The concavity can be a shaped channel 27 cut into the outer surface of the inner sleeve 22. There is male-female engagement of the guide pin means 20 of the outer sleeve 12 into the guide slot means 26 of the inner sleeve 22. The concavity is the female connector to the protrusion of the guide pin means 20 as a male connector. The guide slot means 26 may also be a slit, indentation or other type of concavity.

FIG. 5 shows one embodiment of the guide slot means 26 having a generally z-shaped form. There is a first slot position 28 corresponding to the closed configuration of FIG. 2, wherein the ports 24 and the openings 18 are not in alignment. The ports 24 and openings 18 may be separated longitudinally along the common axis of the sleeves or separated rotationally along the common axis of the sleeves. There is a second slot position 30 corresponding to the opened configuration of FIG. 3, wherein at least one of the ports 24 and the openings 18 are in alignment. The fluid connection between the wellbore and surface is set. The fracturing fluid can be pumped to the pay zone, and after fracturing, the inner sleeve 22 and outer sleeve 12 can remain open for production flow. The frac ball 64 in the pressure seat 62 can be flowed back to surface or dissolved. There is also a third slot position 32 corresponding to a compressed configuration of FIGS. 4 and 6, when the spring means 82 is in a compressed state. FIG. 5 shows the second slot position 30 between the first and third slot positions 28, 32. In the embodiments of the present invention and as shown in FIG. 5, the first, second, and third slot positions, 28, 30, 32 repeat within the guide slot means 26 around the entire circumference of the outer surface of the inner sleeve 22. The repeating sets of slot positions are continuous, with an adjacent first slot position 28' connecting to the previous third slot position 32. The guide pin means 20 of the outer sleeve 12 remains disposed in the channel of the guide slot means 26 all along the outer surface of the inner sleeve 22.

The shifting of the embodiments of the present invention refers to the change in position of the guide pin means 20 through the guide slot means 26. A shift is the guide pin means 20 moving from the first slot position 28 to the second slot position 30. Then, the next shift is the movement of the guide pin means 20 from the second slot position 30 to the third slot position 32 within the guide slot means 26. The next shift is the movement of the guide pin means 20 from the third slot position 32 to the adjacent first slot position 28'. The guide pin means 20 shifts around and around the guide slot means for an unlimited number of times because the guide slot means 26 is a continuous channel around the common axis of the inner sleeve 22 and outer sleeve 12. The starting first slot position 28 is eventually repeated, when the guide pin means 20 completes circumscribing the outer surface of the inner sleeve 22. The frac sleeve system 10 can be closed, opened, and compressed multiple times without limitation and without any wellbore intervention or setting tool. There is no disruption of the production time for operating the frac sleeve system 10 of the present invention.

In embodiments of the present invention, the guide slot means 26 from the first to second slot positions 28, 30 is aligned parallel to the common axis of the inner sleeve 22 and outer sleeve 12. Pressure from the surface shifts the inner sleeve 22 from first slot position 28 to second slot position 30 with generally downward pressure. The guide pin means 20 remains disposed in the guide slot means 26, following the linear path from the first to second slot positions 28, 30 for the longitudinal movement of the inner sleeve 22 along the common axis.

Some embodiments of the present invention also show the guide slot means 26 as curved or bent from the second slot position 30 to third slot position 32, such that the shift is downward pressure and rotational pressure. The guide slot means 26 from the second slot position 30 to the third slot position 32 cannot be totally linear, whether curved or bent or angled. The guide pin means 20 twists and lowers the inner sleeve 22 relative to the outer sleeve 12 by traveling in a non-linear path. Thus, the movement is longitudinal and rotational by the inner sleeve 22 relative to the outer sleeve 12.

Embodiments of the present invention, such as FIG. 5, also show the guide slot means 26 as non-linear from the third slot position 32 to the next first slot position 28'. The guide slot means 26 from the third slot position 32 to the adjacent first slot position 28' cannot be totally linear, whether curved or bent or angled. The guide pin means 20 twists and raises the inner sleeve 22 relative to the outer sleeve 12 by traveling in a non-linear path. Thus, the movement is longitudinal and rotational by the inner sleeve 22 relative to the outer sleeve 12. The pressure to twist and raise the inner sleeve 22 comes from the release of the compressed spring means 82. The upward pressure cannot come from the same surface pressure to shift from closed to opened to compressed. The shift from compressed to closed originates from the compressed spring energy of the spring means 82. The non-linear, or curved or bent or angled path of the guide pin means 20 through the guide slot means 26 from third to first slot position is different from the non-linear path from second to third slot position. The guide pin means 20 must move the inner sleeve 22 from the compressed configuration to the closed configuration, which is a further longitudinal distance than moving from the opened configuration to the compressed configuration. The two curves or non-linear paths form the generally z-shaped slot of the guide slot means 26. The two curves or non-linear paths can be constant curvature, gradual curvature, different curvatures, and partially straight paths in embodiments of the present invention.

Multiple shifts are the repeated movement of the guide pin means 26 through the iterations of the first, second, and third slot positions 28, 30, 32, 28', 30', 32', etc. around the circumference of the inner sleeve 22. Pressure from the surface controls these multiple shifts from closed to opened to compressed, as well as triggering the upward pressure from the spring means 82. The guide slot means 26 houses the guide pin means 20, the guide pin means 20 being slidable within the guide slot means 26 and being moveable along the path determined by the guide slot means 26. From FIGS. 2-5, the closed configuration corresponds to the guide pin means 20 in the first slot positions 28, 28', 28", etc. The opened configuration corresponds to the guide pin means 20 in the second slot positions 30, 30', 30", etc. The compressed configuration corresponds to the guide pin means 20 in the third slot positions 32, 32', 32", etc. The inner sleeve 22 is rotationally and slidably moveable relative to the outer sleeve 12 corresponding to the guide pin means 20 moving through the guide slot means 26.

Embodiments of the present invention also include locking means 42, 52 for locking the shifts from the closed configuration of FIG. 2 and the opened configuration of FIG. 3. The frac sleeve system 10 further includes a top locking ring 34 with a top locking means 42. The top locking means 42 is releasably engaged to the inner sleeve 22 in the closed configuration. There is also a bottom locking means 52 mounted in the bottom housing 16 of the outer sleeve 12, which releasably engages the inner sleeve 22 in the opened configuration. As shown in FIG. 2, the top locking ring 34 has a shoulder in contact with an end of the inner sleeve 22 in the closed configuration. The top locking ring 34 is also a stop to maintain the inner sleeve 22 in position after being returned by the spring means 82. The spring means 82 is prevented from dislodging the inner sleeve 22 beyond the top locking means 42. The top locking means 42 can be comprised of a locking plunger with a compression spring and a locking detent. Other locking means, such as friction-fit attachments and other known mechanism are within the scope of the present invention. The top locking means 42 releasably engages a top locking groove 44 on the inner sleeve 22 to stop longitudinal and rotational movement of the inner sleeve 22 relative to the outer sleeve 12. The locking plunger or equivalent structure prevents the longitudinal movement, and the locking detent or equivalent structure prevents the rotational movement.

The bottom locking means 52 is comprised of a locking plunger with a compression spring, and a locking detent, analogous to the top locking means 42. The bottom locking means 52 releasably engages a bottom locking groove 54 on the inner sleeve 22. In the embodiments shown in FIGS. 2-4, the bottom locking means 52 can also be comprised of a plurality of locking plungers with compression springs, and a plurality of locking detents. The bottom locking means 52 releasably engages a plurality of bottom locking grooves on the inner sleeve 22. Each of the plurality of locking plungers and locking detents having different relative strengths of engaging respective bottom locking grooves. Each of the plurality of locking plungers and locking detents may also be placed longitudinally separate along the common axis of the outer sleeve 12 and the inner sleeve 22. Other variations on the bottom locking means 52 are available within the scope of the present invention. Similar to the top locking means 42, such alternative and equivalent structures must prevent the longitudinal and rotational movement of the inner sleeve 22 relative to the outer sleeve 12 in the opened configuration. The opened configuration is for the pumping of fracturing fluid to the pay zone in the wellbore and for maintaining the fluid connection during production of hydrocarbons from the pay zone.

The pressure control of the shifting of the inner sleeve 22 in the embodiments of the present invention involve the pressure seat means 62 and the spring means 82, which include the structures for exerting the necessary force for the multiple unlimited shifts of the present invention. The pressure seat means 62 is positioned at an upper end of the inner sleeve 22. Pressure from a surface of the wellbore can come from a frac ball 64, tubing pressure or fluid pressure. For an embodiment with a frac ball 64, as shown in FIGS. 2-4, the pressure seat means 62 comprises a ball seat 63 positioned at an upper end of the inner sleeve 22. The ball seat 63 is actuatable by pressure from a surface of the wellbore, after the frac ball 64 engages the ball seat. Fluid pressure on the frac ball 64 and ball seat can release the top locking means 42 so that the inner sleeve 22 moves downward from the closed configuration to the opened configuration. The fluid pressure also engages the bottom locking means 52 to hold the inner sleeve 22 in the opened configuration. Alternatively, the pressure seat means 62 may comprise a float valve with shear pins, wherein weight of fluid from the surface tears shear pins, just as the weight of a frac ball engages the ball seat. Various pressure sensors can be used to trigger the shift from closed configuration to opened configuration, when e-line and coiled tubing prevent the dropping of a frac ball.

FIG. 3 shows a repeat use of the pressure seat means 62 in the shift from the opened configuration to the compressed configuration. While in the opened configuration, the frac ball 64 can be removed. Dissolving or floating the frac ball 64 back to the surface can achieve the removal. The obstruction allows more free fluid connection between the surface and the wellbore. The production from the pay zone is usually performed after removal of the frac ball 64. The bottom locking means 52 maintains position of the inner sleeve 22, such that the pressure is not needed to maintain the opened configuration.

When ready to shift from the opened configuration, again, pressure from a surface of the wellbore can come from a frac ball, tubing pressure or fluid pressure. The pressure seat means 62 is actuated to release the bottom locking means 52 from the bottom locking groove, allowing the inner sleeve 22 to be pushed further down and slightly rotated, according to the guide slot means 26. The bottom locking means 52 are reuseable by spring systems, similar to the top locking means 42. Pressure from the surface triggers this shift from the opened configuration to the compressed configuration.

Figure 6:
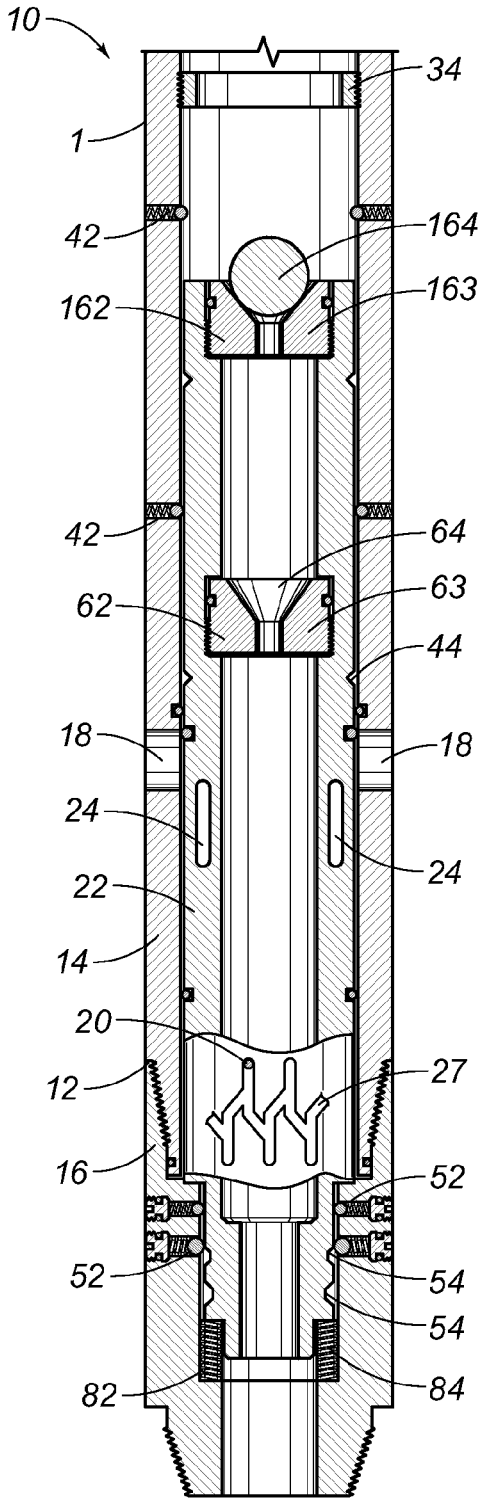
FIG. 6 is another cross-sectional view of another embodiment of the frac sleeve system of the present invention, showing a shift pressure seat means above the pressure seat means.

In an alternative embodiment of FIG. 6, the pressure from a surface of the wellbore for shifting comes from a shifting pressure seat means 162. The shifting pressure seat means 162 also actuates to release the bottom locking means 52 from the bottom locking groove, allowing the inner sleeve 22 to be pushed further down and slightly rotated, according to the guide slot means 26. The shifting pressure seat means 162 is separate from the pressure seat means 62. A different sized shifting frac ball 164 and shifting ball seat 163 can be used for the shifting pressure seat means 162. For example, the shifting frac ball 164 can be different sizes from the frac ball 64 so as to distinguish between pressure to move from closed configuration to opened configuration, from opened configuration to compressed configuration, and from compressed configuration to closed configuration.

As shown in FIG. 4, there is the spring means 82 housed within the bottom housing 16 of the outer sleeve 12 and positioned below the bottom locking means 52. The spring means 82 is comprised of a torqued compression spring 84, which can optionally be encased to protect from downhole conditions and dirt. The spring 84 imparts rotational force and longitudinal force against the inner sleeve 22. The spring means 82 may also be a combination of multiple springs 84 with different compressive and torsion properties. The spring means 82 must impart both rotational force and longitudinal force so that the inner sleeve 22 is properly replaced to the closed configuration according to the guide slot means 26. The guide slot means 26 moves relative to the fixed guide pin means 20 on the outer sleeve rotationally and longitudinally relative to the common axis of the sleeves because of the torque and upward pressure of the spring means 82. The spring means 82 also rotates the inner sleeve 22 so that the bottom locking means 52 can no longer engage the bottom locking groove 54 when returning to the closed configuration. The inner sleeve 22 will not re-lock in the opened configuration as the inner sleeve 22 moves longitudinally upward along the common axis, and the bottom locking means 52 are preserved for re-use. The twisting action of the spring means 82 moves the guide pin means 20 through the guide slot means 26 from third slot positions 32, 32', 32", etc. to first slot positions 28, 28', 28", etc. around a circumference of the inner sleeve 22. Pressure from the surface had moved the guide pin means 20 to the third slot positions 32, 32', 32", and the next shift occurs by the pressure from the spring means 82, which is controlled by the pressure from the surface being removed and amount of force imparted to the inner sleeve from the compression. The compressed configuration with the guided multiple shifts upward and with rotation overcomes the prior art problems of generating the proper upward pressure to replace the inner sleeve 22 to the original closed configuration.

One embodiment of the method of shifting a frac sleeve system of the present invention includes the steps of setting the frac sleeve system 10 in a closed configuration and placing the system 10 in pay zone or frac zone within the wellbore underneath the surface. The system 10 is Run-In-Hole (RIH) with seals, isolating the openings 18 from the inner sleeve 22. The frac ball 64 has not been dropped, and the guiding pin means 20 of the top housing 14 sits in the first slot position 28 of the guiding slot means 26 machined on the outer diameter of the inner sleeve 22. The guiding pin means 20 is moveable along and within the guide slot means 26, when the inner sleeve 22 moves up and down and rotates back and forth relative to the outer sleeve 12.

In embodiments of the present invention, the step of shifting from closed configuration to opened configuration includes the step of applying pressure to the system 10 at the pressure seat means 62. In one example, a frac ball 64 is dropped from the surface to engage the ball seat 63, and pumping fluid against the frac ball 64 and ball seat 63 as the pressure seat means 62 provides the pressure to shift. After the system 10 is placed in the pay zone, the frac ball 64 is dropped from the surface to sit on the pressure seat means 62. The frac ball 64 and/or the fluid pressure from the pumped fluid increase pressures to push the inner sleeve 22 to break the top locking means 42 from the inner sleeve 22. The inner sleeve 22 slides down the outer sleeve 12 to the opened configuration.

The method may further include the step of locking the inner sleeve 22 in the opened configuration by the bottom locking means 52 in the bottom housing 16, such that the system 10 is shifted to the opened configuration by pressure from the surface. During the shifting, the guide pin means 20 remains moving in and along the guide slot means 26 to the second slot position 30. For this shift from closed to opened, the inner sleeve 22 only moves along the longitudinal direction without rotation. The movement of the inner sleeve corresponds to movement of the guide pin means 20 through the guide slot means 26. The method now includes the step of performing the downhole activity, such as fracturing and/or producing from the wellbore. At least one port 24 of the inner sleeve is aligned with at least one opening 18 for fluid connection between the surface and the wellbore in the pay zone or frac zone. In some embodiments with frac ball/ball seat pressure seat means 62, the frac ball 64 is removed by floating to the surface or dissolving for free fluid connection.

This embodiment of the method also includes the step of shifting the inner sleeve from the opened configuration to the compressed configuration. Pressure is applied again on the inner sleeve 22 from the surface of the wellbore. In one example, another frac ball 64 can be dropped from the surface to the same ball seat 63. In another example, a shifting frac ball 164 can be dropped from the surface to a shifting ball seat 63 of a shifting pressure seat means 162. The different pressure seat means 62 and shifting pressure seat means 162 allows different size balls and different pressure to distinguish between shifting between closed and opened and opened to compressed and compressed to closed. The present invention covers differentiating shifting pressure between inner sleeve configurations. With the frac ball 64 and shift frac ball 164 embodiments, size, weight, and the amount of pressure of the frac balls differentiate shifting between configurations. The fluid pressure from opened configuration to compressed configuration of the inner sleeve 22 breaks the inner sleeve 22 from the bottom locking means 52, and the inner sleeve 22 moves downward according to the amount of pressure from the surface and rotates according to the spring means 82 and guide pin 20 within the guide slot 26. The method further includes compressing a spring 82 with the inner sleeve 22 beneath the bottom locking means 52 to be cooperative with the shifting from opened to compressed configuration.

The embodiment of the method next includes moving the system 10 into the compressed configuration, wherein the spring 82 is compressed and stores enough energy to push the inner sleeve 22 back to engage the top locking means 42 of the outer sleeve 12. During the shifting to the compressed configuration, the guide pin means 20 continues to move in and along the guide slot means 26 to a third slot position 32. The non-linear, curved, bent, or angled path along the guide slot means 26 rotates the inner sleeve 22, while moving downward, breaking the lock of the bottom locking means 52 and avoiding damage to the bottom locking means 52 as the inner sleeve 22 passes by the locking detent or locking plunger. The spring means 82 is the torque compression spring to exert rotational and longitudinal forces on the inner sleeve 22.

Once fully compressed, the method of this embodiment includes shifting back to the closed configuration from the compressed configuration. Once pressure from the surface is released, i.e., the fluid pumping against the frac ball 64 or shift frac ball 164 is ceased. Immediately, the spring 82 pushes the inner sleeve 22 upward with rotation until the inner sleeve 22 engages the top locking means 42 again. The top locking ring 34 is a bumper, which prevents over shooting the top locking means 42. The rotational force imparted by the spring 82 is directed according to the guide pin means 20 within the guide slot means 26 on the inner sleeve 22. The inner sleeve 22 will not be locked by the bottom locking means 52 on the longitudinal movement upward because the rotation changed the alignment with any bottom locking groove. During the step of pushing the inner sleeve 22, the guide pin means 20 moves in and along the guide slot means 26 from the third position 32 to another first position 28'. The system 10 has been shifted back into the closed configuration. The steps are repeated for shifting the system 10 an unlimited number of times because the inner sleeve 22 can continuously rotate by the guide slot means 26 circumscribed on the outer diameter. Pressure from the surface downwards and pressure from the spring 82 upward controls the shifting between configurations, and well interventions are not needed.

Embodiments of the present invention provide a frac sleeve system that is reuseable. The system lasts for more than the one or two cycles of the prior art, and no setting tool or other intervention is required to re-set the system. The embodiments of the frac sleeve system of the present invention can be opened and closed repeatedly, so that there is unlimited shifting between the configurations of the inner sleeve. The guide slot is continuous around the outer circumference of the inner sleeve so that the number of shifts is unlimited. Along a circle, the slot has no ending. There is no limited number of ball seats for shifting. There is no need for mechanical intervention by a setting tool. The downward pressure comes from the surface, and the upward pressure comes from the spring means of the system.

The top locking means is also reuseable for holding a closed configuration, and the bottom locking means is also reuseable for holding an opened configuration. The rotational and longitudinal movement along the common axis of the sleeves preserves the use of the locks of the present invention. The guide pin within the guide slot controls is cooperative with the torque and pressure of the spring and pressure seat and shift pressure seat. The locks are not broken with the movement of the inner sleeve over the locking detents or locking plungers. When rotated, the locking means are not damaged by the inner sleeve. The spring is also reuseable for shifting the system back to a closed configuration. The spring is protected and does not remain locked in either compressed or extended positions.

The inner sleeve and the outer sleeve have innovative features for unique interactions between the sleeves during the pressure-controlled shifting. The guide slot on the inner sleeve and the guide pin on the outer sleeve control and direct pushing force and rotational force from the pressure seat means and from the spring means. The control of the rotational force and longitudinal force along the common axis is not disclosed in any prior art. The interaction of the inner sleeve and outer sleeve also avoid damaging the reuseable top and bottom locking means, when shifting between configurations, further extending the working life of the system for multiple shifts. The guide slot and guide pin maintain consistency and accuracy of the shifts. The spring may also impart a pushing force and rotational force for twisting the inner sleeve relative to the outer sleeve in a controlled manner.

The foregoing disclosure and description of the invention is illustrative and explanatory thereof. Various changes in the details of the illustrated structures, construction and method can be made without departing from the true spirit of the invention.

We claim:

1. A frac sleeve system, comprising:

an outer sleeve comprised of a top housing, a bottom housing and a plurality of openings;

an inner sleeve, being positioned within said outer sleeve along a common longitudinal axis of said inner sleeve and said outer sleeve, said inner sleeve being longitudinally and rotationally slidable relative to said outer sleeve along the common axis, said inner sleeve being comprised of a plurality of ports in fluid connection to an interior of said inner sleeve;

a pressure seat means being positioned at an upper end of said inner sleeve, said pressure seat means being actuatable by pressure from a surface of the wellbore;

a bottom locking means mounted in said bottom housing of said outer sleeve; and a spring means housed within said bottom housing of said outer sleeve and positioned below said bottom locking means, wherein at least one of said ports of said inner sleeve aligns with at least one of said openings of said outer sleeve in an opened configuration, wherein said ports of said inner sleeve are not in fluid connection with said openings of said outer sleeve in a closed configuration, and wherein said inner sleeve shifts back and forth between said opened configuration and said closed configuration, and wherein said bottom locking means engages said inner sleeve in said opened configuration.

2. The frac sleeve system, according to claim 1, wherein said outer sleeve comprises a guide pin means at a fixed position on an inner surface of said top housing.

3. The frac sleeve system, according to claim 2, wherein said guide pin means is comprised of a protrusion extending from said inner surface toward an interior of said outer sleeve.

4. The frac sleeve system, according to claim 2, wherein said inner sleeve is comprised of a guide slot means on an outer surface of said inner sleeve, said guide slot means engaging said guide pin means of said outer sleeve, said guide pins means and guide slot means shifting said inner sleeve between opened configuration and closed configuration.

5. The frac sleeve system, according to claim 4, wherein said guide slot means is continuous around a circumference of said outer surface of said inner sleeve.

6. The frac sleeve system, according to claim 5, wherein said concavity is in male-female engagement with said guide pin means, said concavity being a female connector, said guide pin means being a male connector.

7. The frac sleeve system, according to claim 4, wherein said guide slot means is comprised of a concavity in said outer surface of said inner sleeve.

8. The frac sleeve system, according to claim 4, wherein said guide slot means has a first slot position corresponding to said closed configuration, when said guide pin means is disposed in said first slot position, wherein said guide slot means has a second slot position corresponding to said opened configuration, when said guide pin means is disposed in said second slot position, wherein said guide slot means has a third slot position corresponding to a compressed configuration, when said guide pin means is disposed in said third slot position and said spring means is in a compressed state, wherein said inner sleeve shifts from said closed configuration to said opened configuration, and wherein said inner sleeve shifts from said opened configuration to said compressed configuration and then to said closed configuration.

9. The frac sleeve system, according to claim 8, wherein said second slot position is placed between said first slot position and said third slot position within said guide slot means, wherein first, second, and third slot positions repeat within said guide slot means around a circumference of said outer surface of said inner sleeve, wherein an adjacent first slot position follows said third slot position, and wherein said guide pin means remains disposed in said guide slot means through the first, second, and third slot positions and repeated first, second, and third slot positions around said circumference of said outer surface of said inner sleeve.

10. The frac sleeve system, according to claim 8, wherein said guide slot means from said first slot position to said second slot position is parallel to the common axis of said inner sleeve and said outer sleeve, wherein said guide slot means from said second slot position to said third slot position is non-linear with the common axis of said inner sleeve and said outer sleeve, and wherein said guide slot means from said third slot position to another first slot position is non-linear to the common axis of said inner sleeve and said outer sleeve.

11. The frac sleeve system, according to claim 1, wherein said pressure seat means comprises:

a ball seat being positioned at an upper end of said inner sleeve; and a frac ball removably engaged to said ball seat, when dropped from said surface of the wellbore.

12. The frac sleeve system, according to claim 1, wherein said pressure seat means comprises:

a float valve with shear pins, wherein pressure on said float valve releases said shear pins and releases said inner sleeve from said top locking means.

13. The frac sleeve system, according to claim 1, wherein said pressure seat means comprises:

a plurality of ball seats being positioned above said inner sleeve; and a plurality of frac balls corresponding to each ball seat, each frac ball being removably engaged to a respective ball seat.

14. The frac sleeve system, according to claim 1, wherein said outer sleeve comprises a guide pin means at a fixed position on an inner surface of said top housing, wherein said inner sleeve is comprised of a guide slot means on an outer surface of said inner sleeve, said guide slot means engaging said guide pin means of said outer sleeve, said guide pins means and guide slot means shifting said inner sleeve between opened configuration and closed configuration, and wherein said spring means is comprised of a torque compression spring so as to return said inner sleeve from compressed configuration to said closed configuration through said guide pin means in said guide slot means.

15. A method for production from a pay zone within a wellbore, said method comprising the steps of:

installing a frac sleeve system, according to claim 1, wherein said inner sleeve is in said closed configuration, and wherein a guide pin of said outer sleeve is disposed in a first slot position of a guide slot of said inner sleeve;

shifting said inner sleeve from said closed configuration to said opened configuration, when pressure applied to said pressure seat means actuates downward movement of said inner sleeve to said bottom locking means, said downward movement corresponding to movement of said guide pin through said guide slot;

pumping fracturing fluid through said frac sleeve system by fluid connection through at least one of said openings of said outer sleeve and at least one of said ports of said inner sleeve;

fracturing said pay zone within said wellbore and producing from said pay zone;

shifting said inner sleeve from said opened configuration to a compressed configuration, when pressure applied to said inner sleeve actuates downward and rotational movement of said inner sleeve in cooperation with said spring means, said pressure being applied from said surface, said downward and rotational movement corresponding to movement of said guide pin through said guide slot;

shifting said inner sleeve from said compressed configuration to said closed configuration, when pressure applied to said inner sleeve actuates upward and rotational movement of said inner sleeve in cooperation with said spring means, said pressure being applied by said spring means, said upward and rotational movement corresponding to movement of said guide pin through said guide slot; and repeating the steps of shifting said inner sleeve from said closed configuration to said opened configuration, shifting said inner sleeve from said opened configuration to a compressed configuration, and shifting said inner sleeve from said compressed configuration to said closed configuration, according to downhole activity.

16. The method for production, according to claim 15, wherein said step of shifting said inner sleeve from said closed configuration to said opened configuration is comprised of dropping a frac ball from said surface, engaging said frac ball to a ball seat, and applying fluid pressure against said frac ball and said ball seat.

17. The method for production, according to claim 16, wherein said step of shifting said inner sleeve from said opened configuration to a compressed configuration is comprised of dropping a shift frac ball from said surface, engaging said shift frac ball to a shift ball seat, and applying fluid pressure against said shift frac ball and said shift ball seat, said shift frac ball being different from said frac ball, said shift ball seat being different from said ball seat.

18. The method for production, according to claim 15, wherein said step of fracturing and producing is comprised of locking said inner sleeve at said bottom locking means in said opened configuration of said inner sleeve.

19. A frac sleeve system, comprising:

an outer sleeve comprised of a top housing, a bottom housing and a plurality of openings;

an inner sleeve, being positioned within said outer sleeve along a common longitudinal axis of said inner sleeve and said outer sleeve, said inner sleeve being longitudinally and rotationally slidable relative to said outer sleeve along the common axis, said inner sleeve being comprised of a plurality of ports in fluid connection to an interior of said inner sleeve;

a pressure seat means being positioned at an upper end of said inner sleeve, said pressure seat means being actuatable by pressure from a surface of the wellbore;

a bottom locking means mounted in said bottom housing of said outer sleeve;

a spring means housed within said bottom housing of said outer sleeve and positioned below said bottom locking means; and a top locking ring having a top locking means, said top locking ring being affixed in said outer sleeve above said inner sleeve, said top locking means being releasably engaged to said inner sleeve, wherein said top locking means and said inner sleeve are engaged in said closed configuration, wherein at least one of said ports of said inner sleeve aligns with at least one of said openings of said outer sleeve in an opened configuration, wherein said ports of said inner sleeve are not in fluid connection with said openings of said outer sleeve in a closed configuration, and wherein said inner sleeve shifts back and forth between said opened configuration and said closed configuration.

20. A frac sleeve system, comprising:

an outer sleeve comprised of a top housing, a bottom housing and a plurality of openings;

an inner sleeve, being positioned within said outer sleeve along a common longitudinal axis of said inner sleeve and said outer sleeve, said inner sleeve being longitudinally and rotationally slidable relative to said outer sleeve along the common axis, said inner sleeve being comprised of a plurality of ports in fluid connection to an interior of said inner sleeve;

a pressure seat means being positioned at an upper end of said inner sleeve, said pressure seat means being actuatable by pressure from a surface of the wellbore;

a bottom locking means mounted in said bottom housing of said outer sleeve; and a spring means housed within said bottom housing of said outer sleeve and positioned below said bottom locking means, wherein at least one of said ports of said inner sleeve aligns with at least one of said openings of said outer sleeve in an opened configuration, wherein said ports of said inner sleeve are not in fluid connection with said openings of said outer sleeve in a closed configuration, and wherein said inner sleeve shifts back and forth between said opened configuration and said closed configuration, wherein said outer sleeve comprises a guide pin means at a fixed position on an inner surface of said top housing, wherein said inner sleeve is comprised of a guide slot means on an outer surface of said inner sleeve, said guide slot means engaging said guide pin means of said outer sleeve, said guide pins means and guide slot means shifting said inner sleeve between opened configuration and closed configuration, and wherein said guide slot means has a first slot position corresponding to said closed configuration, when said guide pin means is disposed in said first slot position, wherein said guide slot means has a second slot position corresponding to said opened configuration, when said guide pin means is disposed in said second slot position, wherein said guide slot means has a third slot position corresponding to a compressed configuration, when said guide pin means is disposed in said third slot position and said spring means is in a compressed state, wherein said inner sleeve shifts from said closed configuration to said opened configuration, and wherein said inner sleeve shifts from said opened configuration to said compressed configuration and then to said closed configuration.

* * * * *